United States Patent [19]

Wier

[11] Patent Number: 4,611,369

[45] Date of Patent: Sep. 16, 1986

[54] BELT LOCK FOR A SAFETY BELT

[75] Inventor: Franz Wier, Goggingen, Fed. Rep. of Germany

[73] Assignee: TRW Repa GmbH, Alfdorf, Fed. Rep. of Germany

[21] Appl. No.: 705,107

[22] Filed: Feb. 25, 1985

[51] Int. Cl.[4] ..... A44B 11/25

[52] U.S. Cl. ..... 24/642; 24/635; 24/639; 24/640

[58] Field of Search ..... 24/634, 635, 636, 637, 24/639, 640, 642, 648, 651; 297/468

[56] References Cited

U.S. PATENT DOCUMENTS

| | | | |
|---|---|---|---|
| 3,538,558 | 11/1970 | Croft | 24/639 |
| 3,585,692 | 6/1971 | Le Mire | 24/635 |
| 3,698,046 | 10/1972 | Eubank | 24/637 |
| 3,789,492 | 2/1974 | Klink | 24/639 |
| 4,313,246 | 2/1982 | Föhl | 297/468 |
| 4,392,280 | 7/1983 | Gavagan | 24/637 |
| 4,393,553 | 7/1983 | Wier | 24/640 |
| 4,406,044 | 9/1983 | Wier | 24/640 |
| 4,468,843 | 9/1984 | Duclos et al. | 24/635 |
| 4,527,317 | 7/1985 | Straszewski et al. | 24/637 |

FOREIGN PATENT DOCUMENTS

| | | | |
|---|---|---|---|
| 196035 | 3/1908 | Fed. Rep. of Germany | 24/637 |

*Primary Examiner*—Victor N. Sakran

*Attorney, Agent, or Firm*—Yount & Tarolli

[57] ABSTRACT

An improved buckle assembly includes a housing having an inlet opening through which a tongue is inserted into the housing. A latch member is movable between an engaged condition in which the latch member is effective to block withdrawal of the tongue from the housing and a disengaged condition in which the latch member is ineffective to block withdrawal of the tongue from the housing. The latch member is moved from the engaged condition toward the disengaged condition by manual movement of a pushbutton in a direction toward the inlet opening and opposite to the direction of insertion of the tongue into the housing.

3 Claims, 4 Drawing Figures

BELT LOCK FOR A SAFETY BELT

The innovation relates to a belt lock for a safety belt, in particular for rear seats in motor vehicles, which is secured to a preferably flexible fitting member and adapted to be locked to an insert tongue of the safety belt insertable into an insert opening of the lock housing, and for the unlocking of the insert tongue a spring-loaded pushbutton is provided on the lock housing and on actuation exerts an unlocking action on the lock bolt.

In such belt locks it is usual to arrange the pushbutton on the side of the lock housing at which the insert opening for the insert tongue is also disposed, the insertion of the tongue and actuation of the pushbutton taking place in the same direction. Such a belt lock is shown for example by German specification as laid open to inspection No. 3,006,972. In this known means a bolt displaceable transversely of the insertion path of the insert tongue is provided and cooperates directly with an inclined run-up path of the insert tongue in such a manner that when the pushbutton is pressed into the actuated position the bolt moves up to outside the aforementioned insert path against the force of a spring into the opening position.

The problem underlying the innovation is to design a belt lock of the type mentioned at the beginning in such a manner that in particular in emergencies it is easier to find the pushbutton for releasing the safety belt.

This problem is solved according to the innovation in that the pushbutton is disposed at the side of the lock housing opposite the insert opening for the insert tongue, the actuating direction thereof being opposite to the insertion direction of the insert tongue.

It has been found in practice that in certain uses such an arrangement and displacement direction of the pushbutton is advantageous because the actuating direction of the pushbutton runs in a direction in which after unlocking the insert tongue is also removed from the belt lock.

In a belt lock with an ejector spring for the insert tongue known per se and disposed in the lock housing it is advantageous for the spring force of the ejector spring to be greater than that of the pushbutton and for the pushbutton coupled to a bolt locking the insert tongue following the travel position in which the insert tongue is released by the bolt has an excess travel of for example a few millimetres. As a result, when the belt lock during unlocking is pressed against the insert tongue the bolt of the belt lock does not lock again immediately after the unlocking movement.

According to an advantageous further development of the innovation the ease with which the pushbutton on the belt lock is found is improved in that on the lock housing both at the side opposite the insert opening and at the side of the insert opening a pushbutton is provided and both pushbuttons are coupled to a single bolt for the insert tongue. As a result, even in extreme emergencies, for example after an accident, finding and correct actuation of the pushbutton is completely ensured. Preferably, the two pushbuttons with inclined run-up faces according to DE-OS No. 3,006,972 act on a single bolt in opposite actuating directions.

Further advantageous details of the innovation will be apparent from the examples of embodiment illustrated in the drawings and described hereinafter.

Figure 1:
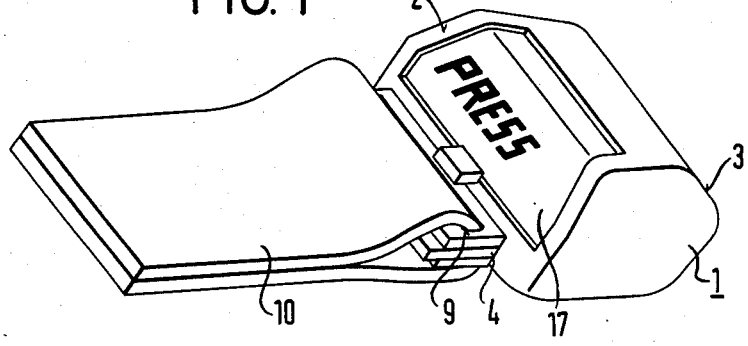
FIG. 1 is a perspective view of the belt lock according to the innovation.
Figure 2:
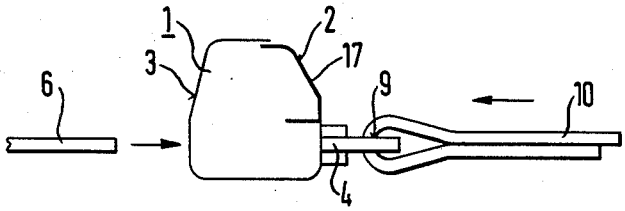
FIG. 2 is a schematic side view of the belt lock according to FIG. 1.
Figure 4:
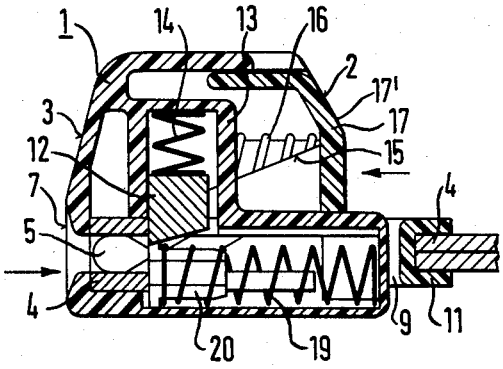
FIG. 4 is a side view of the belt lock according to FIGS. 1 and 2.

The belt lock according to FIGS. 1, 2 and 4 comprises a lock housing 1 having a gable-like cross-section with two inclined gable faces 2 and 3. As the Figures show the supporting part of the lock housing is a metal U-shaped lock support 4 which defines on both sides an insert path 5 for a belt insert tongue 6 to which the free end of a safety belt not otherwise illustrated is secured for example by means of a sewn loop and which is adapted to be inserted into the insert path 5 of the lock housing in the direction of the arrow of FIGS. 2 and 4. The lock support 4 projects beyond the lock housing 1 formed by plastic shells opposite the insert opening 7 of the insert path 5 where the lock support 4 has a slot 9 preferably covered by injection moulded plastic in which a fitting member 10 constructed as flexible belt band is secured by means of a sewn loop according to FIG. 1. The other end of the fitting member 10 is secured for example to the floor portion of the motor vehicle. As illustrated in FIG. 4 the slot 9 in the lock support 4 is provided with a plastic covering 11 which provides edge protection for the looped-in fitting member 10. In this region the parallel plates of the U-shaped lock carrier lie directly on each other whereas in the region of the lock housing 1 these plates are spaced from each other to form the insert path 5. In openings of said plates a bolt 12 is displaceable perpendicularly to the insert path 5, guide portions 13 of the lock housing 1 serving to guide the bolt 12. The bolt, which may be made according to DE-OS No. 3,006,972, is pressed by a spring 14 into the lower closure or locking position. Also in accordance with DE-OS No. 3,006,972 an inclined run-on face 15 of a pushbutton 17 displaceable in the direction of the arrow of FIG. 4 against the force of a spring 16 is in direct coupling connection with the bolt 12. Said pushbutton has in adaptation to the gable form of the lock housing 1 an inclined push face 17' which forms the gable face 2 of the lock housing. On depression of the pushbutton 17 the bolt 12 is displaced out of the locking position in FIG. 4 upwardly against the force of the spring 14 until it is outside of the insert path 5 and the insert tongue 6 thus unlocked. With this unlocking the insert tongue 6 is ejected from the lock housing 1, i.e. from the insert path 5, by an ejector spring 19 with an ejector extension 20. Said ejector spring 19 is tensioned on insertion of the insert tongue 6 into the insert path 5 and now moves into the relaxed position on ejecting the insert tongue 6 from the lock housing 1. After the opening operation the pushbutton 17 is released and under the force of the spring 16 returns into the starting or rest position shown in FIG. 4. The bolt 12 is held by the ejector spring 19 or the extension 20 thereof in the opening position so that the insert tongue 6 can without difficulty again be inserted into the insert path 5. In the example of embodiment according to FIGS. 1, 2 and 4 the pushbutton 17 is disposed at the side of the lock housing 1 which is opposite the insert opening 7, i.e. at the side at which the belt lock is secured to the fitting member 10. The pushbutton 17 is thus actuated in the ejection direction of the insert tongue 6 for unlocking the bolt 12. It is advantageous for the spring force of the ejector spring 19 to be greater than the spring force of the spring 16 of the pushbutton 17 and for the pushbutton 17 cooperating with the bolt 12 to have following the travel position in which the bolt 12 has just left the insert path 5 an excess travel of a few millimetres.

Figure 3:
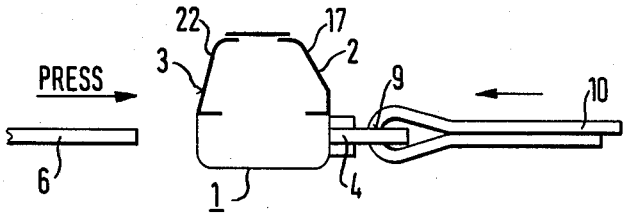
FIG. 3 is a further embodiment of the belt lock according to the innovation having two pushbuttons.

In the example of embodiment of FIG. 3 in addition to the pushbutton 17 according to FIGS. 1, 2 and 4 at the opposite side, i.e. the gable face 3, a further pushbutton 22 is provided, the construction of which corresponds substantially to the pusbutton 17 and which also cooperates via an inclined run-on face with the bolt 12 in such a manner that when said pushbutton 22 is depressed in the arrow direction "PRESS" the bolt 12 is moved into the unlocking position according to FIG. 4.

I claim:

1. A buckle assembly for receiving a tongue to interconnect two sections of a safety belt system, said buckle assembly comprising a housing having an inlet opening into which the tongue is inserted, means for connecting said housing with one of the sections of the safety belt system, a latch member supported for movement relative to said housing in a direction transverse to the direction of insertion of the tongue into said housing, said latch member being movable between an engaged condition in which said latch member is effective to block withdrawal of the tongue from said housing and a disengaged condition in which said latch member is ineffective to block withdrawal of the tongue from said housing, and manually movable pushbutton means slidably mounted on said housing for moving said latch member from the engaged condition toward the disengaged condition in response to manual movement of said pushbutton means in a direction toward said inlet opening and opposite to the direction of insertion of the tongue into said housing, said pushbutton means including a cam surface means which is movable with said pushbutton means to apply force against said latch member in a direction transverse to the direction of insertion of the tongue into said housing.

2. A buckle assembly as set forth in claim 1 further including second pushbutton means slidably mounted on said housing for moving said latch member from the engaged condition toward the disengaged condition in response to manual movement of said second pushbutton means in a direction away from said inlet opening and in the direction of insertion of the tongue into said housing.

3. A buckle assembly as set forth in claim 1 further including first spring means for urging said pushbutton means to an initial position in which said latch member is in the engaged position with a first spring force, an ejector member movable relative to said housing from a retracted position to an extended position to eject the tongue from said housing when said latch member is in the disengaged condition, and second spring means for urging said ejector member to the extended position with a second spring force which is greater than the first spring force.

* * * * *